United States Patent [19]

Graham

[11] Patent Number: 4,769,279

[45] Date of Patent: Sep. 6, 1988

[54] LOW VISCOSITY ETHYLENE ACRYLIC COPOLYMERS FOR NONWOVENS

[75] Inventor: Blair A. Graham, Brights Grove, Canada

[73] Assignee: Exxon Chemical Patents Inc., Linden, N.J.

[21] Appl. No.: 909,536

[22] Filed: Sep. 22, 1986

[51] Int. Cl.[4] ..... B32B 27/02; B32B 27/30; D04H 1/04

[52] U.S. Cl. ..... 428/296; 156/62.4; 264/6; 264/12; 264/14; 428/401; 428/903

[58] Field of Search ..... 264/6, 12, 14; 428/296, 428/401, 903; 156/62.4

[56] References Cited

U.S. PATENT DOCUMENTS 4,013,751 3/1977 Davis et al. .
4,076,698 2/1978 Anderson et al. .
4,078,124 3/1978 Prentice .
4,157,428 6/1979 Hammer .

FOREIGN PATENT DOCUMENTS 264991 12/1963 Australia .

*Primary Examiner*—James C. Cannon
*Attorney, Agent, or Firm*—J. F. Hunt

[57] ABSTRACT

Low viscosity ethylene acrylic copolymers and blends thereof with other fiber-forming polymers for spunbond and melt blown nonwoven applications. Ethylene/alkyl (meth) acrylate, especially ethylene/methyl acrylate copolymers are found to be suitable for fiber-forming operations, especially melt blowing when the melt index is at least about 10. Blends of the copolymer with other fiber-forming polymers are especially suitable for fiber-forming operations. The nonwoven products of the copolymers and blends of the invention show a good degree of elongation making them especially suitable for certain fabric applications and new uses. The nonwoven fabrics are comprised of fibers of the copolymers and blends, having a diameter of about 1–40 microns. Larger fibers may also be formed by various techniques.

37 Claims, No Drawings

LOW VISCOSITY ETHYLENE ACRYLIC COPOLYMERS FOR NONWOVENS

BACKGROUND OF THE INVENTION

This invention is directed to fibers, especially hydrocarbon fibers as well as nonwoven fabrics, sheets, and laminates made therefrom. The invention also relates to ethylene acrylic copolymer products and products made from blends of the copolymer with other fiber-forming polymers.

Many thermoplastic resins may be extruded to form fibers of the monofilament type (relatively large) and very fine denier fibers, especially in nonwoven products. The most commonly used thermoplastic resin for formation of the very fine fibers are polypropylene and polyester, although many other resins have been suggested. It has not been possible to prepare acceptable nonwoven fabrics, webs, mats, and the like from ethylene acrylic copolymers because the extruded copolymers, e.g., ethylene acrylates, due to their high melt strength do not attenuate well to fibers by conventional methods. Thermoplastic resins such as ethylene vinyl acetate copolymers have been used; however, the EVA type copolymers are stable only to about 450° F. and are not useable to blend with polypropylene which has an optimum processing temperature in the range of 500–550° F. The ethylene acrylic copolymers of the invention are stable up to about 610° F. and are therefore suitable for blends with polypropylene for optimum temperature processing.

Small fiber diameters are important for producing many nonwoven applications due to the bacterial efficiency that small fibers produce. The linear low density polyethylene/ethylene acrylic copolymer blends of the invention may be formed into fibers having such small diameters around 4–12 microns in size.

The copolymers and blends of the invention are especially useful in nonwoven structures. Examples of applications of nonwoven materials are diaper interfacings, wound dressings, clothing, sanitary products, medical products, sheeting, drapes, disposable clothing, protective clothing, outdoor fabrics, industrial fabrics, netting, bagging, membranes, filters, rope, cordage, wiping cloths, synthetic papers and tissue papers, and other products. The copolymer and blend fibers, multifilaments, and other nonwoven structures of the invention exhibit improved properties such as softness and low bonding temperatures in comparison to other materials. They have good tenacity and exceptional elongation.

Stretch of fabrics and other nonwoven products made from the blends and copolymers of the invention are especially advantageous in certain applications such as clothing where it is important for the clothing to stretch rather than tear. Another likely application for the nonwoven products of these materials is form-fitting garments, drapes, and the like wherein it is necessary to stretch the fabric somewhat after it is positioned for its intended use.

SUMMARY OF THE INVENTION

Nonwoven products are prepared from thermoplastic ethylene acrylic copolymers or a blend of the ethylene acrylic copolymer with a second fiber-forming thermoplastic material. The ethylene acrylic copolymers of the invention, whether used alone or in combination with a second fiber-forming polymer are especially adaptable to applications where stretch of a fabric or other form is desirable. Furthermore, the ethylene acrylic copolymers and blends of the copolymer with another fiber-forming material are found to be suitable for melt blowing, melt spinning, and similar processes for forming fibers whereas heretofore the use of such ethylene acrylic material for formation of fibers was found to be unavailable because the fibers did not attenuate and form a nonwoven product. Rather, materials of the ethylene acrylic type such as ethylene-methyl acrylate copolymer, when processed in a melt blowing line, resulted in a mass of material which often fell short of the collection drum or self bonded so extensively that a nonwoven product was not formed.

DESCRIPTION OF THE PREFERRED EMBODIMENTS

A preferred embodiment of the present invention is a fiber of about 1–50 micron diameter (up to about 15 denier), comprised of an ethylene acrylic copolymer having a melt flow rate of at least about 10 and an ethylene comonomer content of about 35–99 weight percent, or comprised of a 30–70 weight percent blend of said copolymer with a second fiber-forming polymer.

A preferred embodiment of the present invention is a nonwoven web of fibers having a diameter of about 1–40 microns, said fibers being formed of an ethylene acrylic copolymer having a melt flow rate of at least about 10 and an ethylene comonomer content of about 35–99 weight percent, or being formed of a 30–70 weight percent blend of said copolymer with a second fiber-forming polymer.

A preferred embodiment of the present invention is also an improvement in a process for producing a melt blown nonwoven product wherein a fiber-forming thermoplastic polymer resin or resin blend is extruded in molten form from orifices of a heated nozzle into a stream of gas which attenuates said molten resin or blend into fibers and said fibers are collected on a receiver to form said nonwoven web, the improvement comprising:

extruding from said nozzle orifices a fiber-forming ethylene acrylic copolymer having a melt flow rate of at least about 10 and about 35–99 weight percent ethylene comonomer content, or a 30–70 weight percent blend of said copolymer with a second fiber-forming polymer; and forming a nonwoven web of said copolymer or blend, said web having a base weight of about one ounce per square yard and an elongation at break in the cross direction of at least about 50%.

A preferred embodiment of the present invention is a 30–70 weight percent blend of an ethylene acrylic copolymer having a melt flow rate of at least about 10 and an ethylene comonomer content of about 35–99 weight percent with a second fiber-forming polymer.

A preferred embodiment of the present invention is the use of the copolymers and blends of the invention in a melt blowing process to form a nonwoven product, such as in the manner described in U.S. Pat. No. 4,078,124 which is incorporated herein by reference in its entirety for all purposes. A melt spinning process, generally known to the skilled artisan is also suitable for use with the copolymers and blends of the invention. Other processes for forming nonwovens or individual fibers are also suitable.

In the past, nonwoven products have not been formed from ethylene acrylic copolymers because the viscosity of the copolymers was found to be so high as not to permit formation of a nonwoven product. However, the present invention is the discovery that certain ethylene acrylic copolymers and blends of the copolymer with other fiber-forming materials can in fact be used for the formation of nonwoven products, especially by the melt blowing process. The use of low viscosity ethylene acrylic copolymers for spunbond and melt blown nonwoven applications is disclosed herein.

The ethylene acrylic copolymers of the invention may vary a great deal in the amount of ethylene present in the copolymer. A preferred range for the copolymer is about 35–99 weight percent ethylene, preferably about 52–95 weight percent ethylene, more preferably about 70–90% by weight ethylene.

The acrylic comonomers of the invention are generally of the alkyl (meth) acrylate type. That is they are of the type generally having the formula

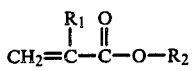

wherein $R_1$ is H or methyl ($CH_3$—) and $R_2$ is an alkyl group, preferably methyl, ethyl, propyl, or butyl, more preferably methyl. $R_1$ is preferably H rather than methyl but the (meth) acrylate or mixtures may be more available in some situations/locations.

The most preferred acrylic comonomer of the invention is methyl acrylate $CH_2CHCOOCH_3$. Another preferred acrylic comonomer is ethyl acrylate $CH_2CHCOOCH_2CH_3$. Generally, the weight percent of acrylic comonomer content may be decreased somewhat where the comonomer content is from ethyl acrylate rather than methyl acrylate.

The amount of acrylic comonomer present in the ethylene acrylic copolymer of the invention may vary significantly depending upon the type of polymerization used, choice of acrylic comonomer, type of process to be used for the copolymer, desired elongation characteristic for a nonwoven product of the copolymer, and process considerations. A useful range of acrylic comonomer content is about 1–65 weight percent and a more commonly used range for fiber-forming processes would be at least about 5–50 weight percent preferably 10–40 weight percent, more preferably at least about 20 weight percent in the case of methyl acrylate or methyl (meth) acrylate and at least about 10 weight percent in the case of ethyl acrylates or larger alkyl acrylates.

According to the invention, fibers may be formed from the copolymer or blends of the invention wherein the fiber diameter is from about 1–50 microns (up to about 15 denier). A preferred range of fiber diameters for the fibers of the invention, especially in the case of spunbond or melt blown fibers is about 1–40 microns, more preferably about 1–15 microns diameter. It has been found that fibers and nonwoven products made from the fibers of the invention have a softer "hand" or feel than polypropylene fibers of comparable size, polypropylene being the most commonly used melt blown thermoplastic material.

The copolymers and blends of the invention comprise an ethylene acrylic copolymer having a melt flow rate of at least about 10. The melt flow rate is variously called the melt index. As used herein, the melt flow rate is expressed in terms of grams per 10 minutes as determined by ASTM D1238 (condition E - 190° C.). Accordingly, a copolymer having a melt flow rate or melt index of about 10 has a flow rate of about 10 grams per 10 minutes as determined by ASTMD1238 (condition E). Preferably, the ethylene acrylic copolymers of the invention have a melt flow rate of at least about 20–500, more preferably about 25–200.

A preferred embodiment of the present invention is a fiber or nonwoven mat formed of a 30–70 weight percent blend of an ethylene acrylic copolymer and a second fiber-forming polymer. More preferably, the blend is about a 40–60 weight percent blend of the ethylene acrylic copolymer and a second fiber-forming polymer, most preferably about 50:50. In one highly preferred embodiment, materials other than the blends or copolymers of the invention are not present in any significant amount.

Various fiber-forming polymers suitable for the blend of the invention include polyolefins, polyamides, polyvinyls, and other polymers. Included are polypropylene, polyethylene, reactor copolymers of propylene with small amounts of ethylene, polyesters, poly(methyl meth acrylate), poly(ethylene terephthate), poly(hexamethylene adipamide), poly(omega-caproamide), poly(hexamethylene sebacamide), polystyrene, and polytrifluorochloroethylene. Favored among these are the polyolefins, especially polyethylene and polypropylene. Useful polyethylenes include low density polyethylene, high density polyethylene and linear low density polyethylene (copolymers of ethylene and lower alkyl comonomers). Highly preferred are linear low density polyethylene and polypropylene.

A preferred range for incorporation of the acrylic copolymer of the invention with the second fiber-forming polymer of the invention to form the blend for fibers is about a 30–70 weight percent blend of said copolymer with the second fiber-forming polymer, a larger range being usable. A useful blend composition is about 50% of the acrylic copolymer of the invention with about 50% polypropylene or linear low density polyethylene. A highly preferred blend for forming fibers, especially by the melt blowing process, is a composition of about 50% polypropylene or 50% linear low density polyethylene with an ethylene methyl acrylate copolymer having about 10–30 weight percent methyl acrylate, preferably about 20% methyl acrylate, and having a melt index of about 25–200, more preferably 50–150.

A preferred operation of the present invention is the melt blowing process using an ethylene acrylic copolymer or blend of the invention to form a nonwoven product. Typical operating temperatures for the melt blowing die when using the copolymers or blends of the invention are about 380–700° F., preferably 400–650 F.

Nonwoven webs in various forms and shapes in accordance with the invention have fibers ranging in diameter from about 1–40 microns, preferably about 1–15 microns or less. The fibers are formed from the ethylene acrylic copolymers or blends of the invention wherein the copolymer portion has a melt flow rate of at least about 10, preferably 20–500.

The ethylene acrylic copolymers of the invention may contain additional components including fillers. However, a preferred embodiment of the invention is a fiber or a nonwoven web formed of an ethylene acrylic copolymer which consists essentially of the copolymer of ethylene and an acrylic comonomer. Similarly, blends of the preferred copolymer are also preferred.

The blend of the invention may be formed by any of the various methods available for forming compounded polymers including various heating and high temperature blending processes. Such processes include Banbury mixing, dry blending, or melt extruding such components to form the polymer for producing the fiber.

The ethylene acrylic copolymers and blends of the invention are especially suited for forming fibers and nonwoven products by melt blowing, spinning, or other techniques. Very fine fibers may be especially by melt blowing, melt spinning, and spray spinning processes. These fibers may in turn be collected as mats, rovings, or other forms of nonwoven product. They can thereafter be processed further by known fiber handling equipment and processes to make garments and other objects of commercial use. The processes of forming the fibers benefit from the ability of the copolymers and blends of the invention to attenuate into fibers so as to provide a nonwoven product of extremely soft "hand" having good strength and elongation characteristics.

The present invention provides fibers and nonwoven products such as fabrics having properties or combinations of properties not otherwise available. The invention shows distinct improvement over specific properties of polypropylene and ethylene vinyl acetate copolymers or blends because of strength and elongation capability. Furthermore, the copolymers are advantageous over EVA's because they may be blended with polypropylene and processed at favorable polypropylene temperatures (above 500° F.). The fabrics are classified by base weight, usually in ounces per square yard. Thus thicker fabrics have a heavier base weight than thinner materials/fabrics.

A better understanding of the invention may be gained by a review of the following examples and accompanying Table. These examples are instructional and not intended to limit the scope or breadth of the invention.

EXAMPLES

Nonwoven products in the form of mats were formed from a ten inch die head on a melt blowing process line fed by an extruder. The product collection drum was located about ten inches from the die head and the die head was operated at about 550° F. The mats were cut into appropriately sized portions and tested by standard methods to determine tenacity, break strength, and Young's Modulus as well as the percent elongation at break in the direction of takeup of the nonwoven product (machine direction) as well in the direction perpendicular to takeup of product on the product collector (cross direction). The die head/nozzle may be operated so as to extrude copolymer or blend at varying rates. An operable range is about 0.1 to 1.0 gram per minute per orifice in the die, preferably about 0.1 to 0.5, more preferably about 0.2 gram per minute per orifice.

The air "knife" may be operated at any rate suitable for forming fabrics. A useable range is 100–300 standard cubic feet per minute (SCFM). About 100–200 SCFM is preferred and 150 SCFM is highly preferred.

The collector/drum may be positioned at various distances from the orifices where resin is expelled so long as the fibers are attenuated and collectable as a fabric. A useable range of separating the nozzle and collector roll is 6–24 inches, preferably 9 6–20 inches, more preferably 8–15 inches.

Young's Modulus reflects the stiffness of a fabric, lower values being a softer, more drapeable fabric. High elongation is desirable in many fabrics to provide stretchable, puncture resistant, form-fitting shapes. Tenacity is a measure of strength, higher values reflecting more strength per unit weight and the possibility of corresponding lower cost.

Using a twenty inch die head having 401 orifices and the equipment described above an ethylene methyl acrylate copolymer having 20 percent by weight methyl acrylate and a melt index of about 6 for comparison was processed. However, the extruded ethylene methyl acrylate copolymer did not attenuate to fibers in the melt blown process and a nonwoven fabric could not be formed.

The following examples demonstrate formation of nonwoven fabrics from polypropylene, linear low density polyethylene, ethylene methyl acrylate copolymers of the invention, ethylene methyl acrylate copolymer/polypropylene blend of the invention, and ethylene methyl acrylate/linear low density polyethylene blend of the invention. The materials were processed in the twenty inch melt blowing die to form a nonwoven product at temperature and pressure settings which were consistent with their formation. The materials of each example and the characteristics of the examples are listed in the table below.

TABLE

| | NONWOVEN FABRIC PROPERTIES | | | | | |
|---|---|---|---|---|---|---|
| POLYMER | FABRIC BASE WEIGHT (OUNCES/YD$^2$) | BREAK STRENGTH (LBS.) | FIBER DIAMETER (MICRONS) | TENACITY (GRAMS/DENIER) MD/CD(1) | ELONGATION AT BREAK (%) MD/CD(1) | MODULUS (MPa) MD/CD(1) |
| LLDPE(2) 0.934 grams/cc MI = 95 (Comparative) | 0.90 | 0.7 | 6.2 | 0.030/0.020 | 25/42 | 6.8/2.8 |
| Polypropylene(3) MI = 95 (Comparative) | 0.95 | — | 5.1 | 0.20/.105 | 36/80 | 7.1/2.6 |
| EVA(4) MI = 190 (Comparative) | 1.00 | 0.4 | 13.6 | 0.021/0.010 | 204/216 | 1.8/1.0 |
| EMA(5) MI = 25 | 0.94 | — | — | 0.027/0.015 | 60/140 | 1.1/0.6 |
| EMA MI = 70 | 0.83 | — | — | 0.035/0.010 | 63/135 | 2.3/0.18 |
| EMA MI = 120 | 1.08 | — | — | 0.020/0.010 | 103/110 | 1.30/0.17 |
| EMA MI = 138 | 1.04 | — | — | 0.020/0.020 | 65/126 | 1.8/0.18 |
| EMA MI = 147 | 1.12 | — | 12–15 | 0.020/0.010 | 67/91 | 1.5/0.30 |
| Polypropylene(6) | 1.10 | — | — | 0.033/0.019 | 185/188 | 3.34/0.80 |

TABLE-continued

| POLYMER | FABRIC BASE WEIGHT (OUNCES/YD²) | BREAK STRENGTH (LBS.) | FIBER DIAMETER (MICRONS) | TENACITY (GRAMS/DENIER) MD/CD(1) | ELONGATION AT BREAK (%) MD/CD(1) | MODULUS (MPa) MD/CD(1) |
|---|---|---|---|---|---|---|
| | NONWOVEN FABRIC PROPERTIES | | | | | |
| EMA Blend MI = 138 LLDPE(7) | 1.00 | — | 8–9 | 0.028/0.018 | 118/129 | 2.04/0.85 |
| EMA Blend MI = 147 LLDPE(8) | 1.00 | 0.9 | 5.5 | —/— | 70/— | —/— |
| EVA Blend (Comparative) EMA MI = 46 | 1.95(9) | — | — | 0.036/0.020 | 102/137 | 2.9/1.4 |

(1)MD = Machine direction; CD = Cross direction.
(2)Exxon Chemical Company LPX-61 linear low density polyethylene.
(3)Exxon Chemical company PP-3145 isotactic polypropylene.
(4)EVA = Exxon Chemical Company LD-764.36 ethylene-vinyl acetate, 28 weight percent VA.
(5)EMA = Ethylene-methyl acrylate copolymer, 20 weight percent MA.
(6)50 weight percent Exxon Chemical Company PP-3145 isotactic polypropylene; 50 weight percent ethylene-methyl acrylate of MI = 120 and 20 weight percent MA.
(7)50 weight percent Exxon Chemical Company LPX-61 linear low density polyethylene; 50 weight percent ethylene-methyl acrylate of MI = 70 and 20 weight percent MA.
(8)50 weight percent LPX-61 LLDPE, 50 weight percent LD-764.36 EVA (28 weight percent VA).
(9)This sample has double thickness which gives higher modulus value.

Examination of the above table reveals that the ethylene acrylic copolymers of the invention have excellent elongation while maintaining good fabric strength. Furthermore, the blends of the invention are noted to have exceptional elongation over that of either the polyolefin component of the blend or the acrylic copolymer component of the blend. Accordingly, the copolymers in blends of the invention are not only capable of producing valuable nonwoven products having soft 'hand' and good strength characteristics but provide materials which have an elongation characteristic especially suited for certain applications where stretching of the material (rather than tearing or puncturing) is important.

The skilled artisan will recognize that certain aspects and features of the invention may be varied somewhat without departing from the scope or spirit of the invention which is defined by the appended claims.

What is claimed is:

1. A melt-blown fiber of about 1–50 microns diameter comprised of an ethylene acrylic copolymer having a melt flow rate of at least about 10 and an ethylene comonomer content of about 35–99 weight percent, or being formed of a 30–70 weight percent blend of said copolymer with a second fiber-forming polymer.

2. The fiber of claim 1 wherein said melt flow rate is about 20–500.

3. The fiber of claim 2 wherein said melt flow rate is about 25–200.

4. The fiber of claim 1 of about 1–40 microns diameter.

5. The fiber of claim 4 of about 1–15 microns diameter.

6. The fiber of claim 1 wherein said ethylene acrylic copolymer is an ethylene/alkyl (meth) acrylate.

7. The fiber of claim 6 wherein said alkyl (meth) acrylate is an alkyl acrylate.

8. The fiber of claim 7 wherein said alkyl acrylate is a lower alkyl acrylate.

9. The fiber of claim 8 wherein said lower alkyl acrylate is methyl acrylate.

10. The fiber of claim 1 comprised of an ethylene acrylic copolymer.

11. The fiber of claim 10 comprised of ethylene-methyl acrylate copolymer.

12. The fiber of claim 1 wherein said ethylene acrylic copolymer has an acrylic comonomer content of about 10–40 weight percent.

13. The fiber of claim 12 wherein said copolymer has an acrylic comonomer content of about 20–40 weight percent.

14. The fiber of claim 13 wherein said acrylic comonomer is an alkyl (meth) acrylate.

15. The fiber of claim 14 wherein said alkyl (meth) acrylate is methyl acrylate.

16. The fiber of claim 1 comprising a 30–70 weight percent blend of an ethylene acrylic copolymer and a second fiber-forming polymer.

17. The fiber of claim 16 wherein said second fiber-forming polymer is a polyolefin.

18. The fiber of claim 17 wherein said polyolefin is a polypropylene homopolymer or copolymer.

19. The fiber of claim 17 wherein said polyolefin is a polyethylene homopolymer or copolymer.

20. The fiber of claim 17 wherein said polyolefin comprises about 50 weight percent of said blend.

21. The fiber of claim 17 of about 1–40 microns diameter, wherein said copolymer component of the blend has a melt flow rate of about 20–500.

22. A nonwoven web of melt-blown fibers having a diameter of about 1–40 microns, said fibers being formed of an ethylene acrylic copolymer having a melt flow rate of at least about 10 and an ethylene comonomer content of about 35–99 weight percent, or being formed of a 30–70 weight percent blend of said copolymer with a second fiber-forming polymer.

23. The nonwoven web of claim 22 wherein said fibers are formed of an ethylene acrylic copolymer having a melt flow rate of about 20–500.

24. The nonwoven web of claim 23 wherein said copolymer has a melt flow rate of about 25–200.

25. The nonwoven web of claim 22 wherein said fibers have a diameter of about 1–15 microns.

26. The nonwoven web of claim 22 wherein said web has a base weight of about one ounce per square yard has an elongation at break in the cross direction of at least about 50 percent.

27. The nonwoven web of claim 26 wherein said web has an elongation at break in the cross direction of at least about 90 percent.

28. The nonwoven web of claim 22 wherein said ethylene acrylic copolymer is an ethylene alkyl (meth) acrylate.

29. The nonwoven web of claim 28 wherein said alkyl (meth) acrylate is a lower alkyl acrylate.

30. The nonwoven web of claim 29 wherein said lower alkyl acrylate is methyl acrylate.

31. The nonwoven web of claim 22 wherein said ethylene acrylic copolymer has an acrylic comonomer content of about 10–40 weight percent.

32. The nonwoven web of claim 31 wherein said comonomer content is about 20–40 weight percent.

33. The nonwoven web of claim 22 comprising a 30–70 weight percent blend of an ethylene acrylic copolymer and a second fiber-forming polymer.

34. The nonwoven web of claim 33 wherein said second fiber-forming polymer is a polyolefin.

35. The nonwoven web of claim 33 wherein said web consists essentially of a 30–70 weight percent blend of an ethylene-methyl acrylate copolymer and polyethylene or polypropylene.

36. In a process for producing a melt-blown nonwoven product wherein a fiber-forming thermoplastic polymer resin or resin blend is extruded in molten form from orifices of a heated nozzle into a stream of gas which attenuates said molten resin or blend into fibers and said fibers are collected on a receiver to form said nonwoven web, the improvement comprising:

extruding from said nozzle orifices a fiber-forming ethylene acrylic copolymer having a melt flow rate of at least about 10 and about 35–99 weight percent ethylene comonomer content, or a 30–70 weight percent blend of said copolymer with a second fiber-forming polymer; and forming a nonwoven web of said copolymer or blend, said web having a base weight of about one ounce per square yard and an elongation at break in the cross direction of at least about 50 percent.

37. The process of claim 36 wherein said molten resin is extruded at about 400–650° F. at the rate of about 0.2 grams per minute per orifice, said resin is attenuated to fibers with said stream of gas at at least about 150 SCFM, and said fibers are collected on said receiver at about 8–15 inches from said heated nozzle.

* * * * *